US008744282B2

(12) United States Patent
Tsuchida

(10) Patent No.: US 8,744,282 B2
(45) Date of Patent: Jun. 3, 2014

(54) IMAGE FORMING APPARATUS INCLUDING TONER CONTAINER INFORMATION SENSING AND POSITIONING FEATURES

(75) Inventor: Takeshi Tsuchida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 12/775,668

(22) Filed: May 7, 2010

(65) Prior Publication Data

US 2010/0290792 A1 Nov. 18, 2010

(30) Foreign Application Priority Data

May 12, 2009 (JP) ..... 2009-115465

(51) Int. Cl.
*G03G 15/00* (2006.01)
*G03G 15/08* (2006.01)

(52) U.S. Cl.
USPC ..... 399/12; 399/13; 399/120

(58) Field of Classification Search
USPC ..... 399/12–13, 24–25
See application file for complete search history.

(56) References Cited

U.S. PATENT DOCUMENTS 6,240,262 B1 5/2001 Taniyama et al.
6,587,648 B1 * 7/2003 Taniyama ..... 399/12
6,895,191 B2 * 5/2005 Rommelmann et al. ..... 399/12

FOREIGN PATENT DOCUMENTS

JP 2003-280349 A 10/2003

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image forming apparatus capable of preventing erroneous reading of an information recording part on a toner container from occurring when the distance between a reading unit and the information recording part changes due to the rotational deflection of the toner container. The reading unit reads information from the information recording part formed on the outer periphery of the toner container. A holding roller comes into contact with the outer periphery of the toner container to position the toner container. The reading unit and the holding roller are arranged on respective lines substantially identical to each other in a direction of a normal to the rotation axis of the toner container.

6 Claims, 13 Drawing Sheets

IMAGE FORMING APPARATUS INCLUDING TONER CONTAINER INFORMATION SENSING AND POSITIONING FEATURES

BACKGROUND OF THE INVENTION

1. Field of the Invention

The present invention relates to an image forming apparatus, such as a copier or a printer, which is capable of reading information attached to a toner container.

2. Description of the Related Art

Conventionally, there has been proposed an image forming apparatus configured such that when a toner container having an information recording part (e.g. a barcode) containing serial numbers and information on compatible models and the like is mounted in the image forming apparatus, an optical sensor in the image forming apparatus reads the information recording part (see e.g. Japanese Patent Laid-Open Publication No. 2003-280349).

The image forming apparatus determines, based on the information read by the optical sensor, whether or not the toner container is compatible with the image forming apparatus, and stops the operation of the image forming apparatus when the mounted toner container is incompatible.

Image forming apparatuses differ in in-apparatus temperature between models thereof, and toner-softening temperature is also different between the models. For this reason, when a toner in a toner container incompatible with an image forming apparatus is used, blocking (toner solidification) or the like occurs, which can impair image quality or damage the image forming apparatus.

Therefore, it is required to accurately read the information recording part on the toner container. Further, it is required to avoid stopping the operation of the image forming apparatus based on an erroneous determination that a toner container is incompatible with the image forming apparatus, despite the fact that the toner container is actually compatible.

However, if the distance between the optical sensor and the information recording part changes due to the rotational deflection of the toner container being rotated, the amount of received light decreases or a spot diameter at a reading position changes, which lowers the reading resolution.

In particular, the toner container is formed to be hollow with a thin wall so as to be filled with toner, and hence is difficult to mold with high accuracy, and further the shape of the toner container is apt to change depending on the use environment. Therefore, the toner container tends to have a large rotational deflection, which can cause erroneous reading or result in a reading error.

SUMMARY OF THE INVENTION

The present invention provides an image forming apparatus which is capable of preventing erroneous reading of an information recording part on a toner container from occurring when the distance between a reading unit and the information recording part changes due to the rotational deflection of the toner container.

The present invention provides an image forming apparatus in which a toner container is rotatably mounted, comprising a sensor configured to read information from an information recording part formed on an outer periphery of the toner container, and a positioning member configured to come into contact with the outer periphery of the toner container to position the toner container, wherein the sensor and the positioning member are disposed on respective lines substantially identical to each other in a direction of a normal to a rotation axis of the toner container.

According to the present invention, it is possible to prevent erroneous reading of the information recording part from occurring when the distance between the reading unit and the information recording part changes due to the rotational deflection of a toner container.

Further features of the present invention will become apparent from the following description of an exemplary embodiment with reference to the attached drawings.

DETAILED DESCRIPTION OF THE EMBODIMENTS

The present invention will now be described in detail below with reference to the accompanying drawings showing embodiments thereof.

Figure 1:
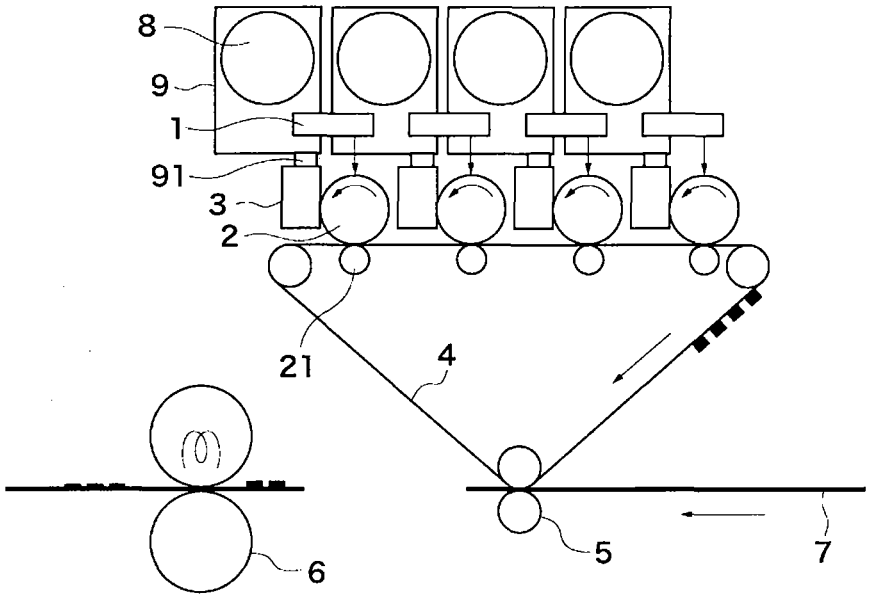
FIG. 1 is a view of essential parts of an image forming apparatus according to a first embodiment of the present invention.

FIG. 1 is a view of essential parts of an image forming apparatus according to a first embodiment of the present invention.

As shown in FIG. 1, the image forming apparatus, such as a copier or a printer, forms an electrostatic latent image, based on print data, on each of photosensitive members 2 by an associated latent image generating unit 1, and then forms a toner image by an associated developing unit 3. The toner images are transferred onto an intermediate transfer member 4 in superimposed relation by respective first transfer units 21 and the resulting toner image is then transferred onto a sheet 7 by a secondary transfer unit 5. The toner image transferred onto the sheet 7 is fixed on the sheet 7 by a fixing unit 6, and the sheet 7 is discharged via a discharge port, not shown.

Although in the above, the color image forming apparatus is taken as an example, the present invention is not limited to color image forming apparatuses.

Toner to be used by each developing unit 3 to form a toner image is supplied from an associated one of toner containers 8 each removably and rotatably mounted in the image forming apparatus. More specifically, a toner is supplied from a toner container 8 to an associated one of hopper units 9, and the toner supplied to the hopper unit 9 is fed to an associated developing unit 3 from a hopper outlet 91.

Figure 2:
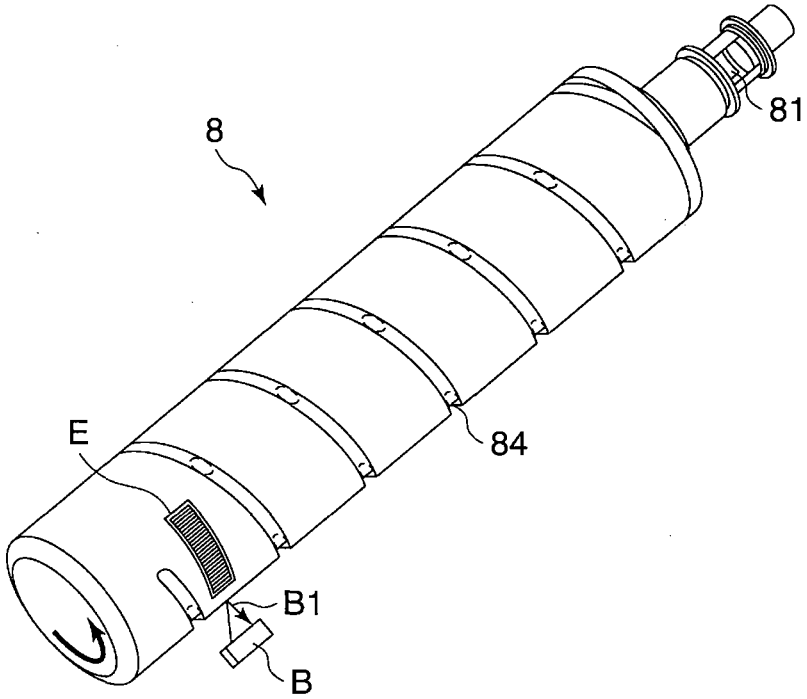
FIG. 2 is an appearance perspective view of a toner container.

A general image forming apparatus is configured as above. FIG. 2 shows an example of the toner container 8 which is removably mounted in the image forming apparatus.

FIG. 2 is an appearance perspective view of the toner container 8.

In FIG. 2, the toner container 8, which has a hollow cylindrical shape, is filled with a predetermined amount of toner. The toner container 8 is rotated to thereby convey toner therefrom to a replenishing port 81 and replenish the associated hopper unit 9 with the toner.

The toner container 8 has an outer periphery thereof formed with a spiral groove 84 corresponding to a spiral rib, not shown, formed on the inner surface thereof, so that toner in the toner container 8 can be conveyed toward the replenishing port 81 by rotating the toner container 8. It is to be understood that insofar as the spiral rib is formed on the inner surface of the container, toner can be conveyed, and hence the toner container 8 may have a smooth outer peripheral surface.

Further, the outer periphery of the toner container 8 has an information recording part E (a barcode in the illustrated example) attached thereon as shown in FIG. 2, and a reading unit B as a reading means reads information from the information recording part E. The reading unit B appearing in FIG. 2 is implemented by a reflective optical sensor.

Figure 3:
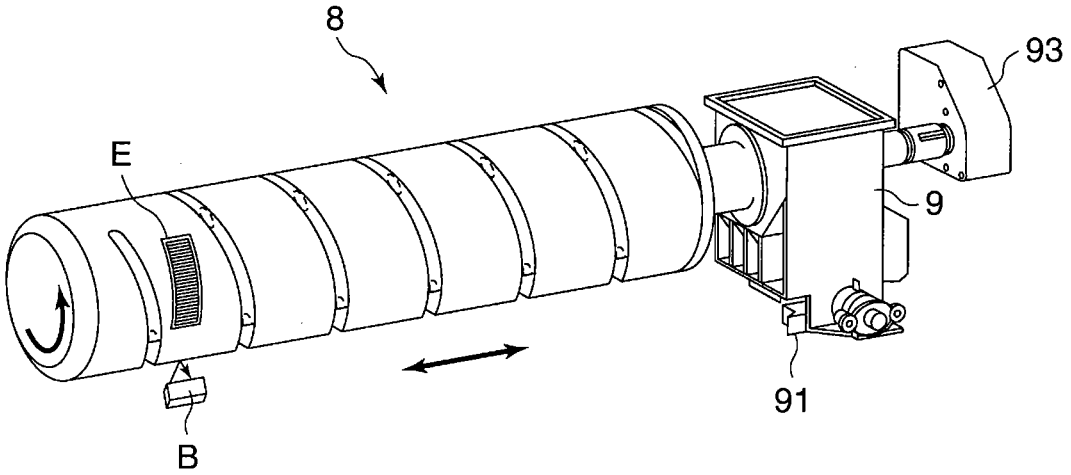
FIG. 3 is an appearance perspective view of the toner container in a state mounted to a hopper unit.

FIG. 3 is an appearance perspective view of the toner container 8 in a state mounted to the hopper unit 9.

The toner container 8 shown in FIG. 2 is mounted to the hopper unit 9 of the image forming apparatus, as shown in FIG. 3. The toner container 8 is mounted and removed to and from the hopper unit 9 in directions indicated by a double-headed arrow in FIG. 3. Further, a motor 93 for rotating the toner container 8 is shown in FIG. 3.

Figure 4:
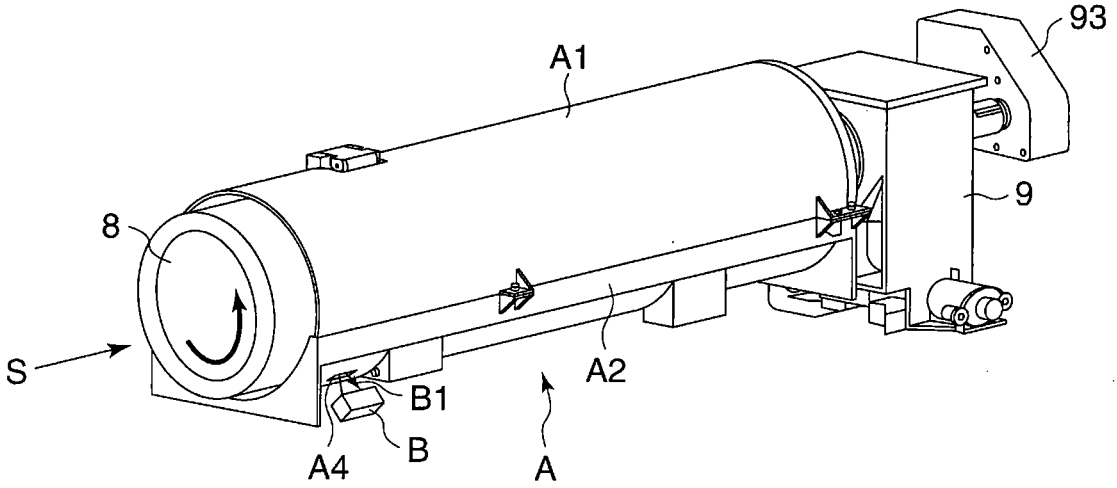
FIG. 4 is an appearance perspective view of the toner container and the hopper unit, and a holding unit of the image forming apparatus formed to cover the toner container.

FIG. 4 is an appearance perspective view of the toner container 8 and the hopper unit 9, and a holding unit A (upper and lower holders A1 and A2) formed to cover the toner container 8.

As shown in FIG. 4, a light beam B1 from the reading unit B passes through a light window A4 formed in the lower holder A2, to read information from the information recording part E on the toner container 8. It should be noted that although in FIG. 4, the holding unit A comprises the two holders (upper and lower holders) A1 and A2 in view of easy mounting, this is not limitative.

Further, although the information recording part and the reading unit are realized by combining the barcode and the reflective sensor as mentioned above, this is not limitative, but the information recording part may be implemented e.g. by a magnetic member, and the reading unit e.g. by a magnetic sensor.

Figure 5:
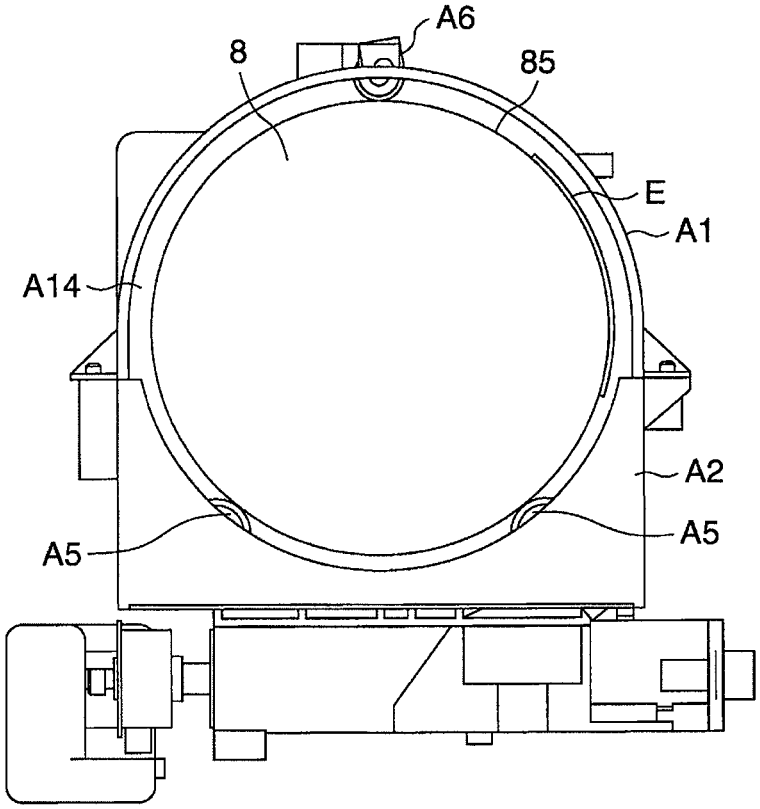
FIG. 5 is a view of the toner container as viewed in a direction S in FIG. 4.
Figure 6:
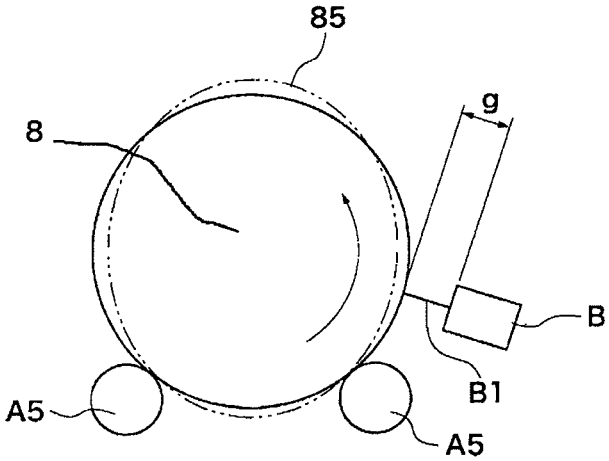
FIG. 6 is a view useful in explaining the rotational deflection of the toner container.
Figure 7:
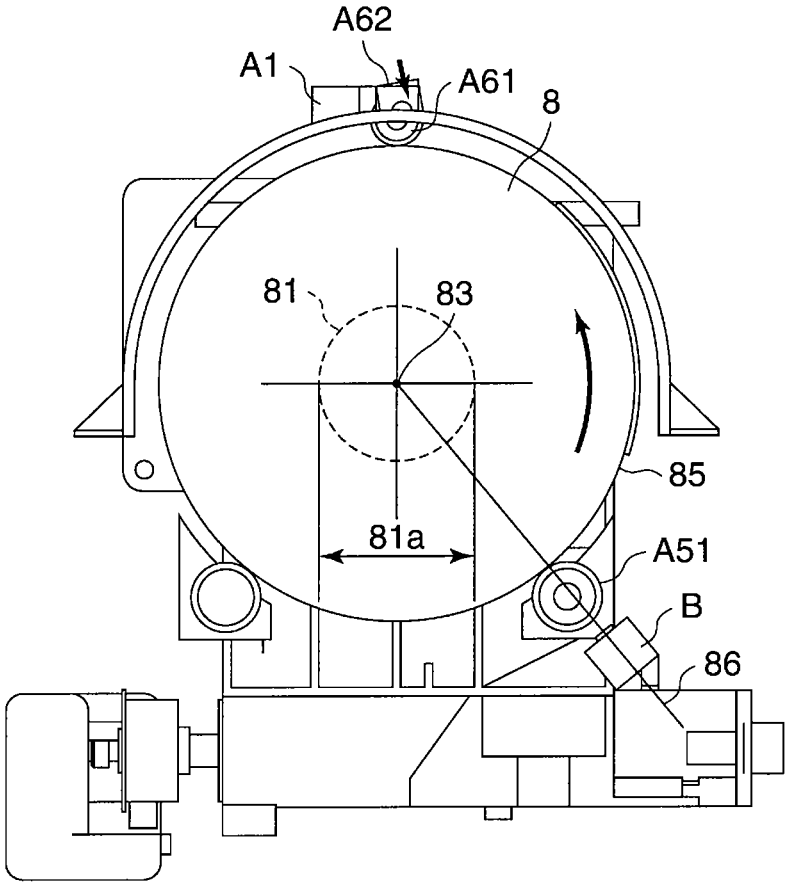
FIG. 7 is a front view of the arrangement of the toner container and a reading unit.
Figure 8:
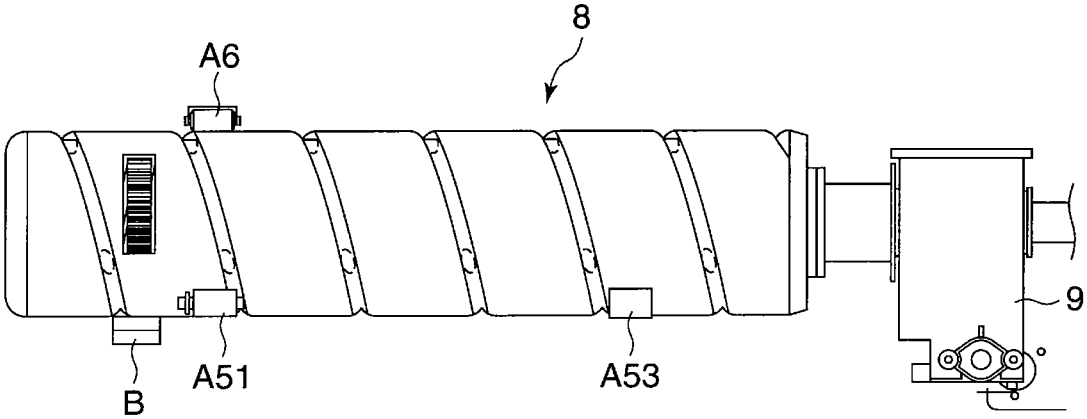
FIG. 8 is a side view of the arrangement of the toner container and the reading unit.
Figure 9:
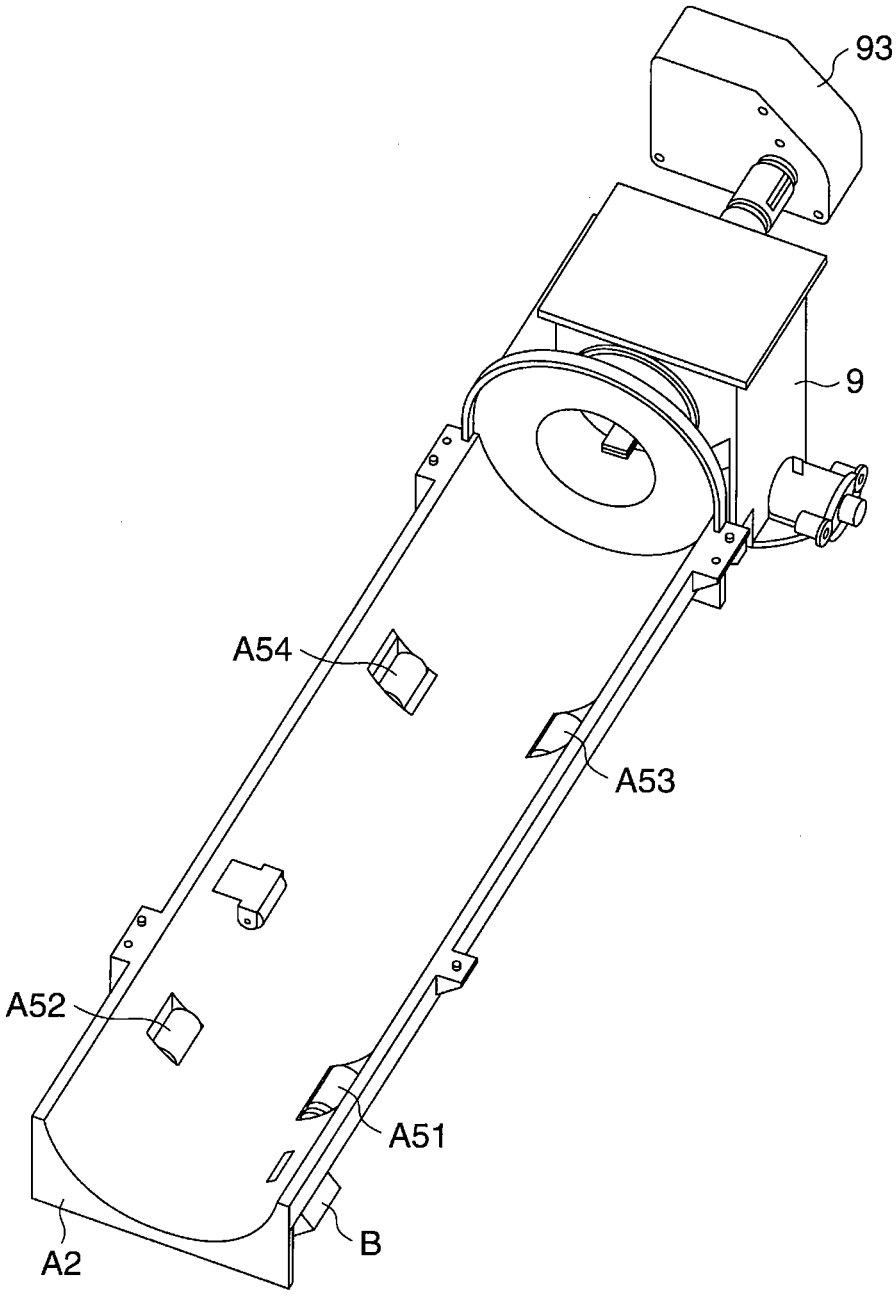
FIG. 9 is a top perspective view of a lower holder of the holding unit.

FIG. 5 is a view of the toner container 8 as viewed in a direction S in FIG. 4, and FIG. 6 is a view useful in explaining the rotational deflection of the toner container 8. FIG. 7 is a front view of the arrangement of the toner container 8 and the reading unit B, and FIG. 8 is a side view of the same. FIG. 9 is a top perspective view of the lower holder A2.

FIG. 5 shows a state where the toner container 8 has its outer periphery held by holding rollers A5 provided in the holder A and is urged toward the holding rollers A5 by a pressure application device A6. It should be noted that the pressure application device A6 is not an essential component.

In FIG. 5, the outer periphery 85 of the toner container 8 is depicted to present a perfect cylindrical shape. Actually, however, it is difficult to form the toner container 8 such that it has a perfect cylindrical shape, due to influence of molding error (e.g. caused by eccentricity between an inner mold and an outer mold), as illustrated by a phantom line in FIG. 6. There are various models of the toner container 8, and e.g. when the toner container 8 has a cylinder diameter of $\phi 100$, rotational deflection of several millimeters occurs.

Therefore, in a case where the reading unit B is disposed at an arbitrary location, as the toner container 8 rotates in a direction (counterclockwise direction) indicated by an arrow in FIG. 6, the distance g between the reading unit B and the outer periphery 85 of the toner container 8 changes. As a consequence, e.g. when the reading unit B is implemented by an optical sensor, the amount of received light is reduced, or a spot diameter at a reading position (position of the information recording part) changes, which makes it impossible to read information of the information recording part E (e.g. a barcode).

To solve this problem, the reading unit B is at least disposed on a line substantially identical to a line on which one (holding roller A51) of the holding rollers A5 as rotary members is disposed, in the direction of a normal 86 to a rotation axis 83 of the toner container 8. In the present example, the diameter of the toner container is set to 40 to 150 mm. Further, in the present example, the line connecting the holding roller A5 and the rotation axis 83 (center of rotation) of the toner container 8 and the line connecting the center of rotation of the toner container 8 and the reading unit B are allowed to form an angle, insofar as the angle is within 10 degrees. Preferably, the angle is within 5 degrees.

A toner agglomerate attached to the replenishment port 81 can fall due to vibration the like of the toner container 8 caused by an operation for mounting or removing the same. The reading unit B is disposed outward of an area 81*a* defined by projection of the outer periphery of the replenishment port 81 of the toner container 8 in the direction of gravity, as shown in FIG. 7, so as to prevent the reading unit B from being soiled.

The toner container 8 is configured such that its outer periphery is always held in contact with the holding roller A51 as a positioning member during rotation of the toner container 8. The reading unit B is disposed close to the holding roller A51 in the longitudinal direction of the toner container 8.

FIG. 7 shows the pressure application device A6 (a pressing roller A61 and a pressing spring A62) as viewed from the front. FIG. 8 shows that the holding roller A51 and the pressure application device A6 are located at substantially the same position in the longitudinal direction of the toner container 8. With this arrangement, it is possible to always hold the holding roller A51 in contact with the outer periphery 85 of the toner container 8 as described above.

FIG. 9 shows an example of an arrangement of the holding rollers A5. The four holding rollers A5 (A51 to A54) are arranged as shown in FIG. 9. In this case, the toner container 8 is necessarily in contact with at least three points, but since the weight balance varies e.g. due to the position of toner filling the toner container 8, it is difficult to envisage which three points are to be in contact with the toner container 8.

Therefore, by disposing the pressure application device A6 and the holding roller A51 at the respective locations in FIG. 7 as described above, the outer periphery 85 of the toner container 8 and the holding roller A51 are always held in contact with each other. In addition, by the above-described disposition and the arrangement of the reading unit B and the holding roller A51 can also hold constant the distance between the reading unit B and the information recording part E.

It should be noted that the pressure application device A6 can be effectively provided even in a case where the four holding rollers A5 are not used. For example, the pressure application device A6 can be provided even in a case where the toner container 8 is supported at three points, i.e. the two holding rollers A51 and A52 and a portion of the holding unit A in contact with the replenishment port 81.

Figure 10:
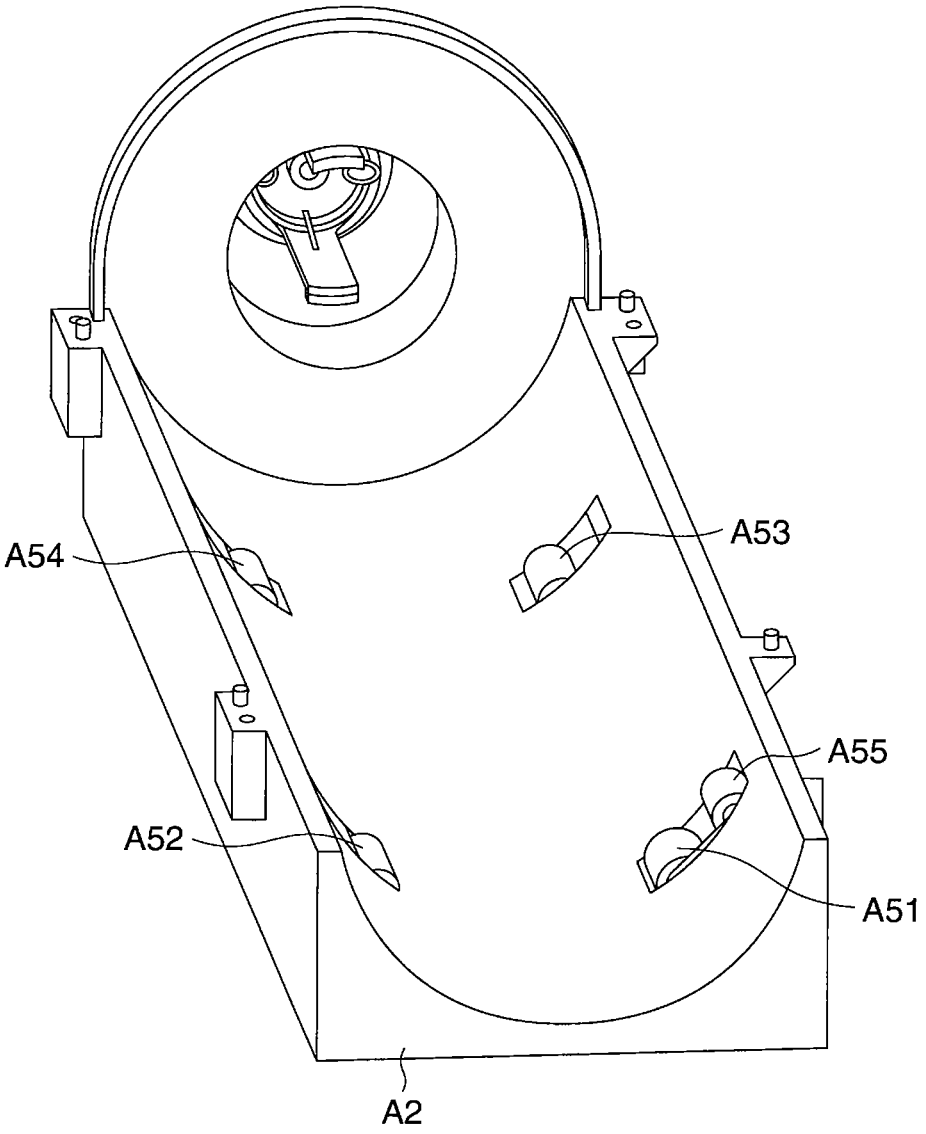
FIG. 10 is a top perspective view of a lower holder of a holding unit of an image forming apparatus according to a second embodiment of the present invention.
Figure 11:
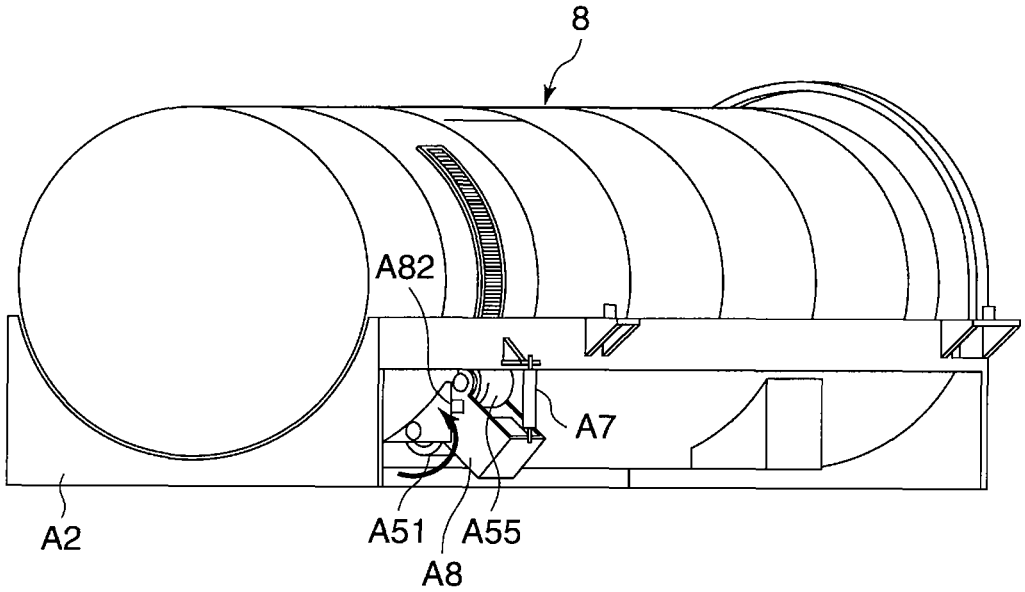
FIG. 11 is an appearance perspective view of the toner container in a state held by the lower holder.
Figure 12:
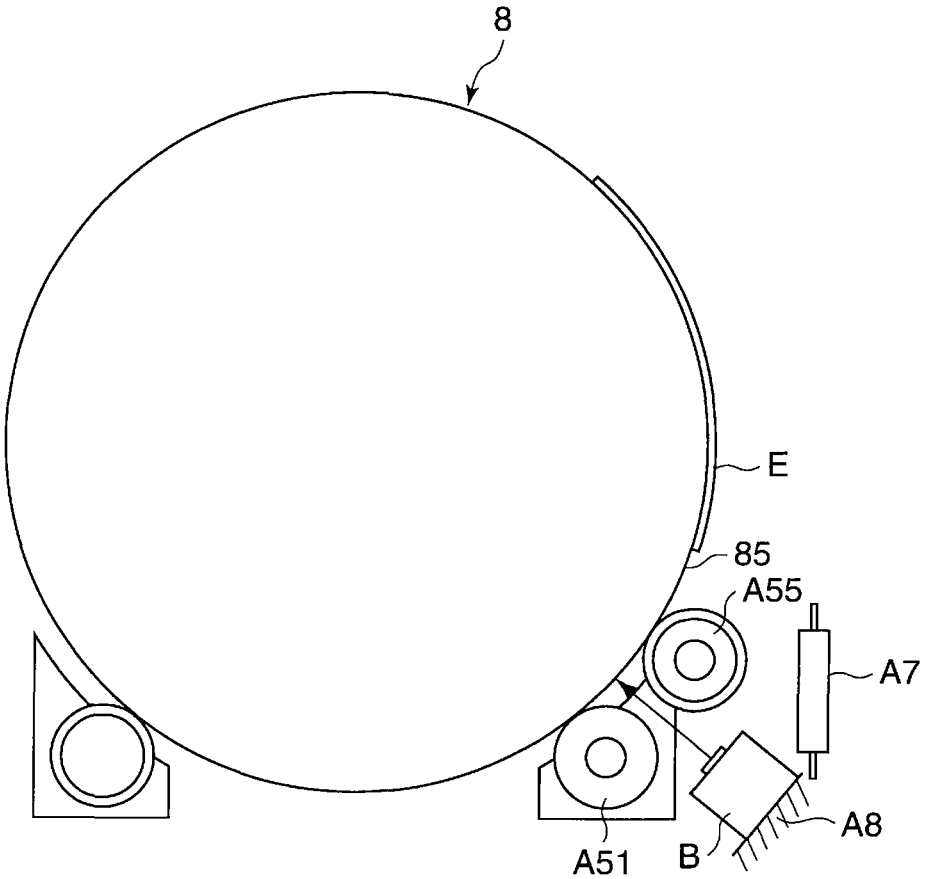
FIG. 12 is a front view of the toner container in the state held by the lower holder.

Next, a second embodiment of the present invention will be described with reference to FIGS. 10 to 12 showing essential parts thereof. The component elements corresponding to those in the first embodiment are denoted by the same reference numerals, and description of those having the same construction as in the first embodiment is omitted. FIG. 10 is a top perspective view of the lower holder A2. FIG. 11 is an appearance perspective view of the toner container in a state held by the lower holder A2. FIG. 12 is a front view of the toner container in the state held by the lower holder A2.

In the second embodiment, in addition to the holding roller A51, there is provided a second contact roller A55 which is disposed adjacent to the holding roller A51 in a circumferential direction of the toner container 8, and is pivotally movable with reference to the holding roller A51 such that the second contact roller A55 is brought into contact with the outer periphery of the toner container 8.

As shown in FIG. 11, the second contact roller A55 is provided on a holder A8, so as to serve as a second positioning member. The holder A8 is pivotally movable about the rotation axis of the holding roller A51. Further, the holder A8 is urged toward the toner container 8 by a spring A7, whereby the second contact roller A55 is held in contact with the outer periphery 85 of the toner container 8.

FIG. 12 shows a positional relationship between the toner container 8, the holding roller A51, the second contact roller A55, the holder 8A and the reading unit B provided on the holder 8A. As the second contact roller A55 moves along the outer periphery 85 of the toner container 8, the reading unit B also moves along the outer periphery 85 of the toner container 8. Therefore, in addition to the holding roller A51 holding the distance between the reading unit B and the outer periphery 85 of the toner container 8 constant, as described hereinbefore, the reading angle of the reading unit B with respect to the information recording part E is also held constant more reliably.

Next, a description will be given of the construction including the second contact roller A55 described with reference to FIG. 10.

Figure 13:
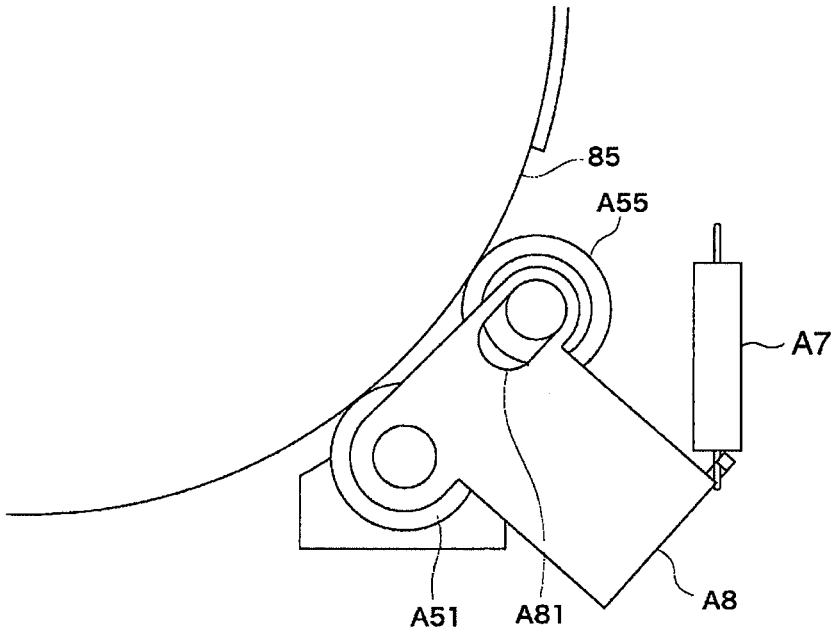
FIG. 13 is a view showing a state of a second contact roller before being moved.
Figure 14:
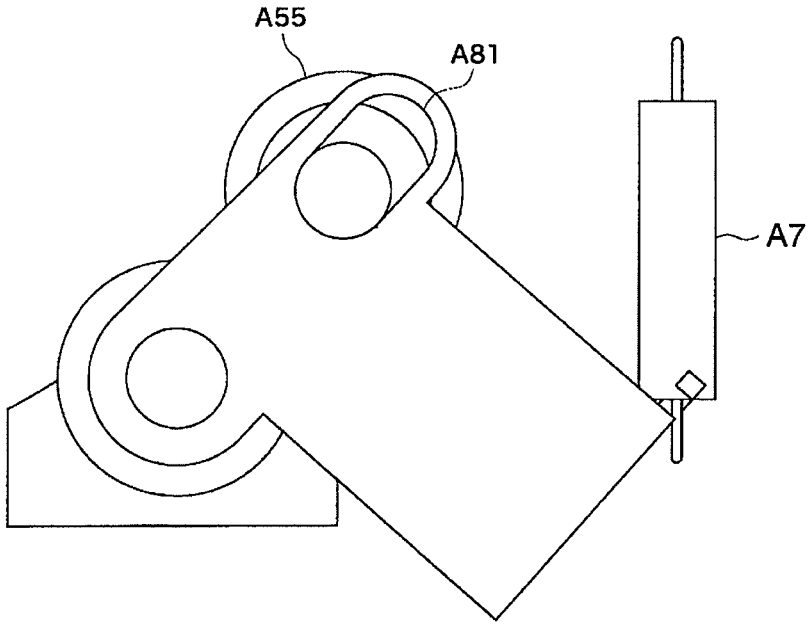
FIG. 14 is a view showing a state of the second contact roller after being moved.
Figure 15:
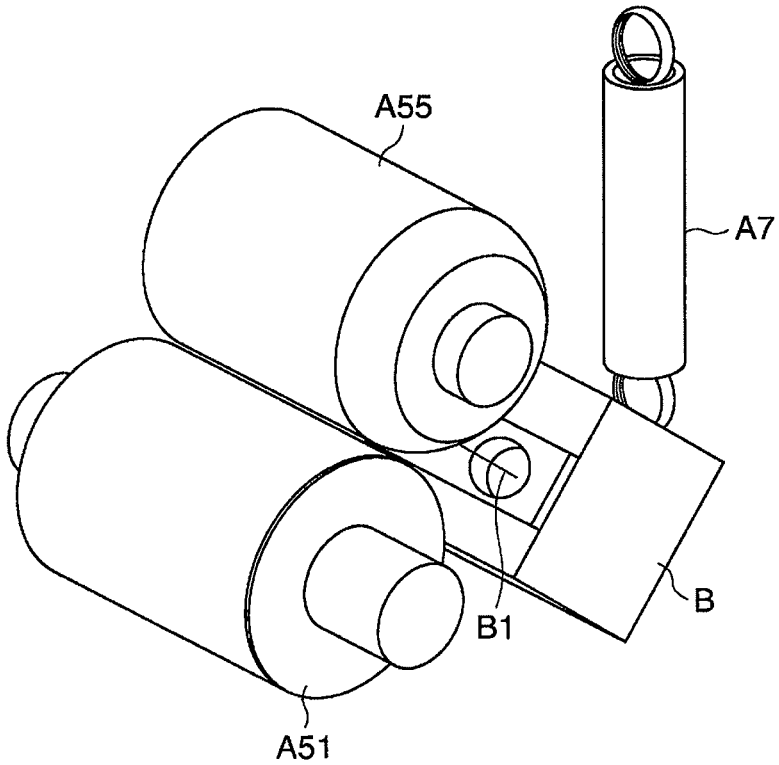
FIG. 15 is an appearance perspective view illustrating the relationship between the holding roller and the second contact roller, and the reading unit.

FIG. 13 is a view showing a state of the second contact roller A55 before it is moved. FIG. 14 is a view showing a state of the second contact roller A55 after it is moved. FIG. 15 is an appearance perspective view illustrating the relationship between the holding roller A51 and the second contact roller A55, and the reading unit B.

FIG. 13 shows a state where the toner container 8 is mounted. As shown in FIG. 13, a bearing part A81 of the second contact roller A55 of the holder A8 is configured to have a slot shape such that the second contact roller A55 can shift along the length of the slot shape. More specifically, in a state where the toner container 8 has been removed, the second contact roller A55 shifts toward the holding roller A51, as shown in FIG. 14, to block the optical path of the reading unit B. FIG. 15 also shows the same state.

With this construction, even when toner is scattered by an operation for removing the toner container 8, it is possible to protect the reading unit B from the scattered toner. In an operation for mounting the toner container 8, the second contact roller A55, which is configured to be urged toward the toner container 8, returns to the FIG. 13 state by itself.

A stopper A82 (see FIG. 11) is provided so as to prevent the holder A8, which is urged toward the toner container 8 by the spring A7, from entering the holding unit A beyond a necessary degree.

It should be noted that in the case of the FIG. 13 example as well, it is possible to clean toner deposited on the holding roller A51 and the second contact roller A55, using a cleaning unit, not shown, to thereby prevent the toner on the rollers from soiling the reading unit B.

Figure 16:
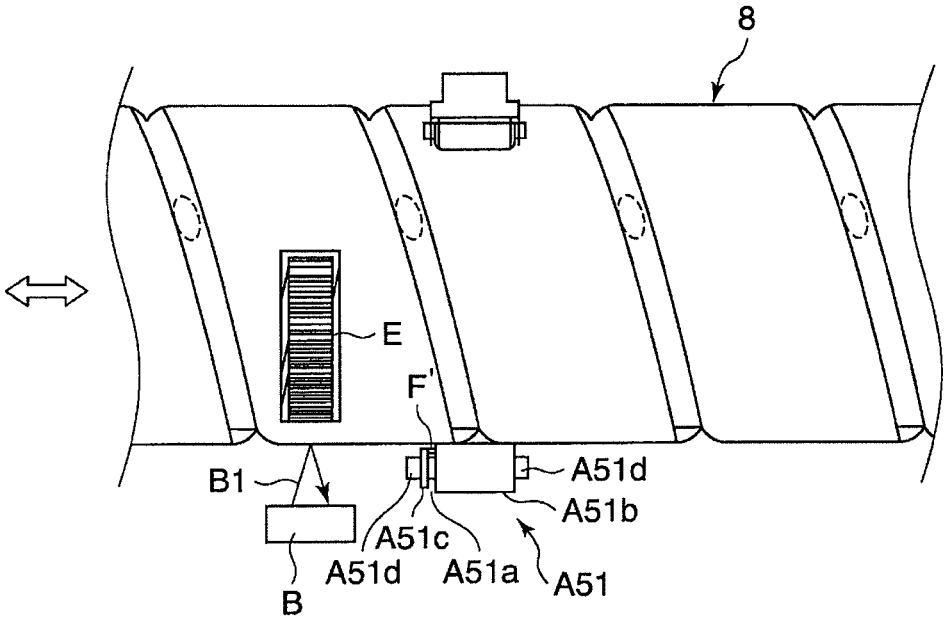
FIG. 16 is a detailed side view of the toner container, the reading unit, and a holding roller of a lower holder of a holding unit of an image forming apparatus according to a third embodiment of the present invention.
Figure 17:
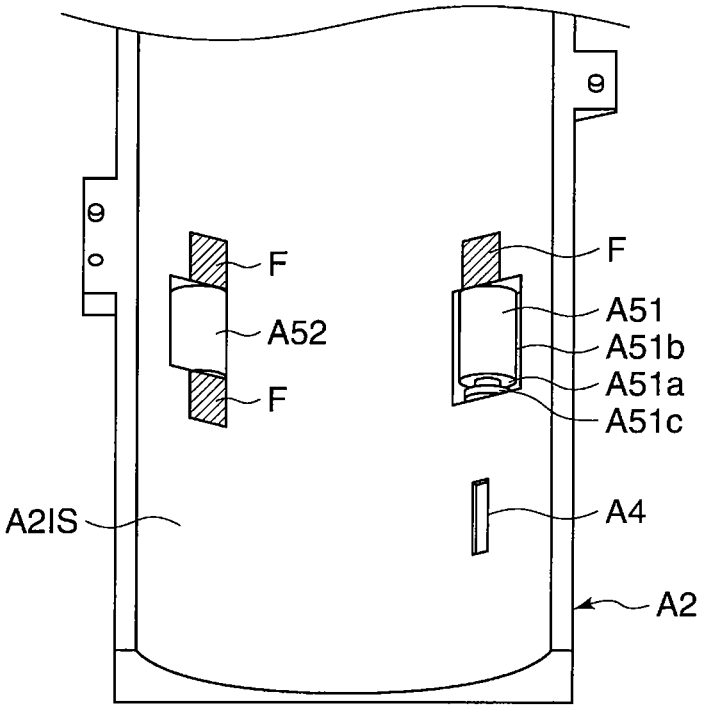
FIG. 17 is a top perspective view illustrating toner soils in the vicinity of holding rollers of the lower holder.
Figure 18:
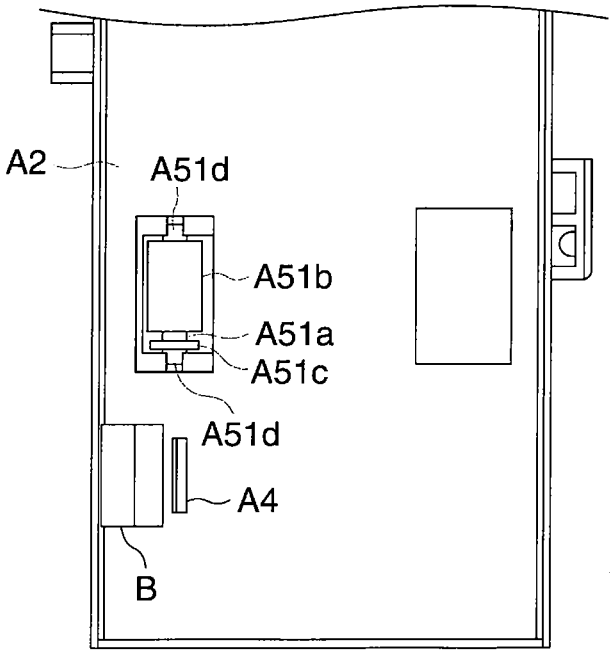
FIG. 18 is a bottom view of FIG. 17.

Next, a third embodiment of the present invention will be described with reference to FIGS. 13 to 18 showing essential parts thereof. The component elements corresponding to those in the first and second embodiments are denoted by the same reference numerals, and description of those having the same construction as in the first and second embodiments is omitted. FIG. 16 is a detailed side view of the toner container 8, the reading unit B, and the holding roller A51. FIG. 17 is a top perspective view illustrating toner soils in the vicinity of the holding rollers A51 and A52 of the lower holder A2. FIG. 18 is a bottom perspective view of FIG. 17.

In FIG. 16, directions for mounting and removing the toner container 8 to and from the image forming apparatus are indicated by a double-headed arrow. Not a little of toner scattered from the replenishment port 81 is suspended in the air in a gap A14 (see FIG. 5) between the holding unit A of the image forming apparatus and the toner container 8 and is deposited on the outer periphery 85 of the toner container 8.

At this time, if the toner container 8 is moved in the direction for mounting or removing the same, the toner deposited on the outer periphery 85 is scraped off by the holding rollers A5 held in contact with the outer periphery 85. In FIG. 17, the scraped-off and accumulated toner is illustrated as hatched areas F.

In this case, in an area extending on an internal surface A2IS of the lower holder A2 from the holding roller A51 to the light window A4, there is no accumulated toner for the following reason: As shown in FIGS. 16 and 17, the holding roller A51 is formed with a groove A51*a*, and has a contact portion A51*b* formed on one side of the groove A51*a* and a non-contact portion A51*c* on the other side of the groove A51*a*, so that toner scraped off F' by an end of the contact portion A51*b* toward the groove A51*a* falls into the groove A51*a*.

The non-contact portion A51*c* of the holding roller A51 is formed on the other side of the groove A51*a*, which is toward the light window A4, so as to prevent the toner having fallen into the groove A51*a* formed on a shaft A51*d* of the holding roller A51 and deposited thereon from moving onto an end of the shaft portion A51*d* fitted in the lower holder A2 of the image forming apparatus to thereby hinder rotation of the holding roller A51, or moving to the light window A4 to thereby block an optical path of the reading unit B. It is to be understood that the non-contact portion A51*c*, which is kept from contact with the outer periphery 85 of the toner container 8, does not scrape off toner.

FIG. 18 is a view of FIG. 17 as viewed from below, and shows the holding roller A51 fitted in the lower holder A2 via the shaft A51*d*.

If scraped-off toner accumulates in the light window A4, the toner drops from the light window A4. In such a case, if the reading unit B is disposed below the light window A4, the toner is likely to accumulate on the reading unit B as well and block the optical path of the reading unit B, causing reading error. Therefore, it is assumed that the reading unit B is disposed at such a location as prevents the above-mentioned inconvenience.

Figure 19A:
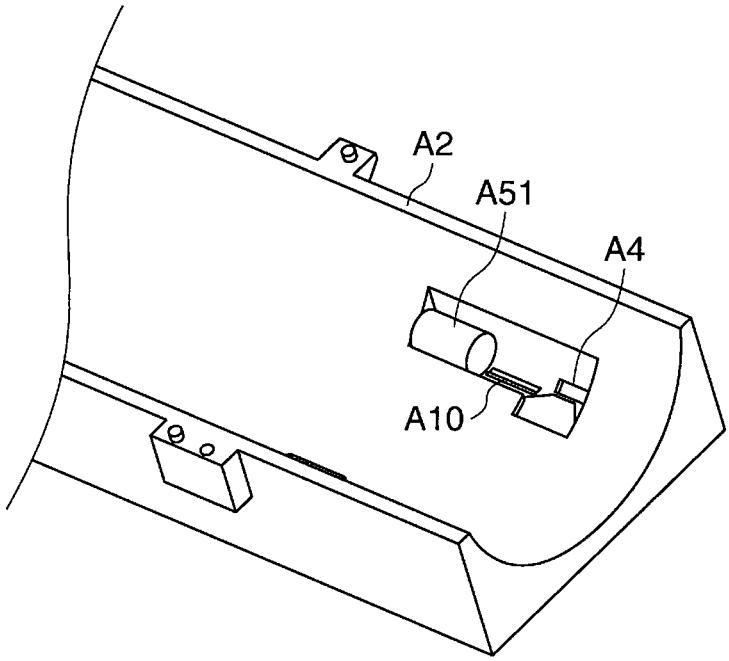
FIGS. 19A and 19B are top perspective views of a lower holder, which are useful in explaining the positional relationship between a holding roller and a light window in an image forming apparatus according to a fourth embodiment of the present invention.

Next, a fourth embodiment of the present invention will be described with reference to FIGS. 19A to 22 showing essential parts thereof. The component elements corresponding to those in the first to third embodiments are denoted by the same reference numerals, and description of those having the same construction as in the first to third embodiments is omitted. FIGS. 19A and 19B are top perspective views of the lower holder A2, each of which are useful in explaining the positional relationship between the holding roller A51 and the light window A4 in the present embodiment.

FIG. 19A shows the lower holder A2 in a state when the toner container 8 is mounted. In this state, the light window A4 is open, so that the reading unit B can perform reading. When the toner container 8 is removed, the holding roller A51 is moved to a position shown in FIG. 19B, to close the light window A4, i.e. cover the reading unit B.

The holding roller A51 is held in contact with the outer periphery 85 of the toner container 8 as described hereinbefore and hence can be moved by this contact with the outer periphery 85. In the present embodiment, the outer periphery 85 of the toner container 8 is configured such that it has a moving part (rib in FIG. 20A) 87 formed thereon as shown in FIG. 20A, for moving the holding roller A51.

Figure 20A:
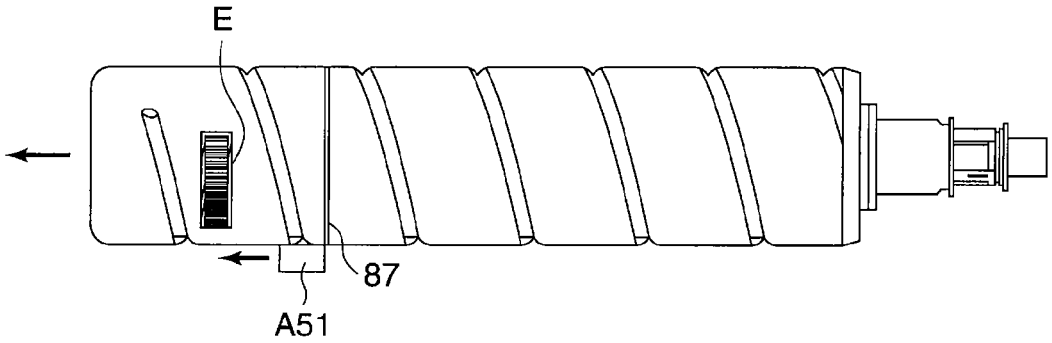
FIGS. 20A and 20B are side views which are useful in explaining the positional relationship between the holding roller and the light window.
Figure 20B:
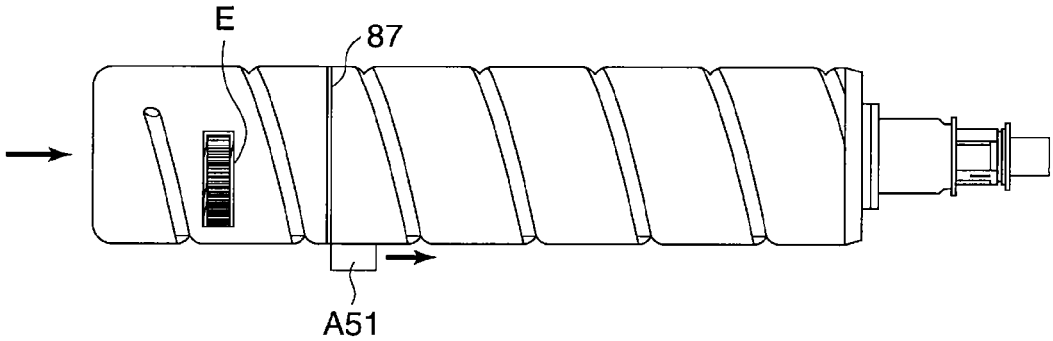

FIGS. 20A and 20B are side views which are useful in explaining the positional relationship between the holding roller A51 and the light window A4.

FIG. 20A shows the toner container 8 in a state in which it is mounted. This state corresponds to the state as shown in FIG. 19A. When the toner container 8 is removed from this state in a direction indicated by an arrow in FIG. 20A, the holding roller A51 is brought into engagement with the moving part 87 to move toward the light window A4. The resulting state of the holding roller A51 after removal of the toner container 8 corresponds to the state shown in FIG. 19B.

Thus, the holding roller A51 can be moved by the moving part 87 in accordance with the operation for removing the toner container 8. This enables the holding roller A51 to close the light window A4 quickly to thereby quickly block the optical path of the reading unit B.

Figure 19B:
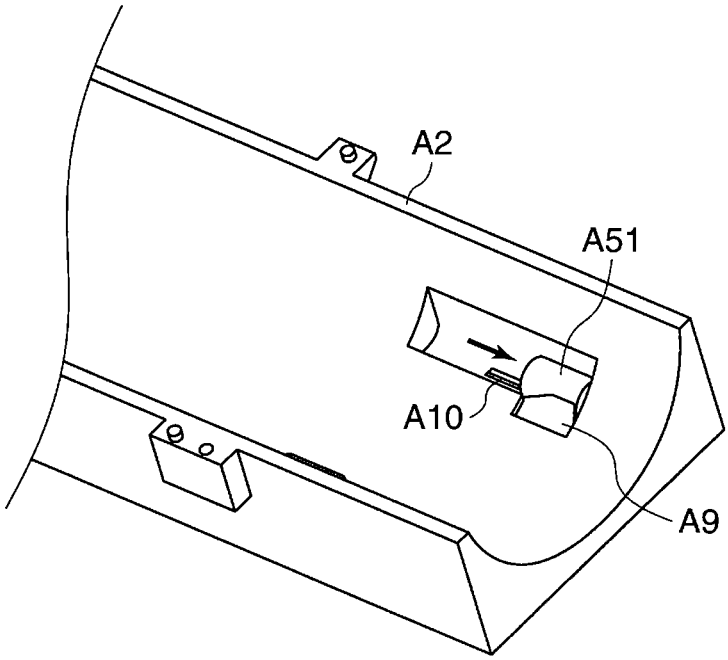

Further, a fixing part A9 is shown in FIG. 19B. When a large amount of toner is dropped from the replenishment port 81 by an operation for removing the toner container 8, the scattered toner is likely to be attached to the holding roller A51 as well. If the holding roller A51 rotates at such a time, the toner attached to the holding roller A51 can pass through the light window A4 and soil the reading unit B. To prevent this convenience, the fixing part A9 is provided, as shown in FIG. 19B, so as to inhibit the holding roller A51 from rotating in such a case.

Figure 21:
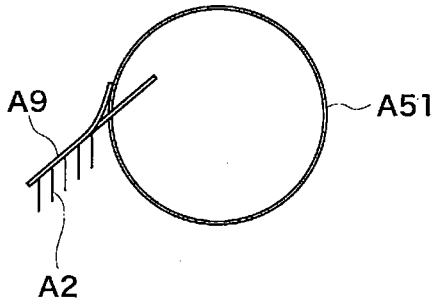
FIG. 21 is a view illustrating the relationship between the holding roller and a fixing part.

This state is also illustrated in FIG. 21. The holding roller A51 is rotated e.g. by vibration caused by an operation for removing the toner container 8 or vibration caused when the image forming apparatus is moved in a state in which the toner container 8 is removed therefrom. When it is necessary to provide only a holding force sufficient for preventing the holding roller A51 from being rotated by the vibration, it suffices that the fixing part A9 is formed by an elastic member, such as a leaf spring or a PET sheet.

More specifically, the moving part 87 forcibly causes the holding roller A51 to be moved to the position shown in FIG. 19B (i.e. to be placed in the state blocking the optical path of the light window A4), and the fixing part A9 is configured such that during this moving process, the holding roller A51 pushes aside the fixing part A9 by itself. In the state shown in FIG. 19B, the rotation of the holding roller A51 is restrained by the resilient force of the fixing part A9. This, however, is only an example, and hence is not limitative.

Next, in mounting the toner container 8, the toner container 8 is moved in a direction indicated by an arrow in FIG. 20B. At this time, the holding roller A51 is brought into engagement with the moving part 87 to be moved in a direction for opening the light window A4 to a position shown in FIG. 19A where the holding roller A51 is stopped, but the toner container 8 is further pushed in until the moving part 87 is brought to a position shown in FIG. 20A after climbing over the holding roller A51.

In FIGS. 19A and 19B, there is shown a mountable portion A10. The holding roller A51 cannot move without climbing over the mountable portion A10. That is, the holding roller A51 is configured such that it cannot be moved unless an external force is applied by engagement of the moving part 87 on the outer periphery 85 of the toner container 8 with the contact portion A51*b* of the holding roller A51.

During the process of mounting the toner container 8, the holding roller A51 remains blocking the optical path the light window A4 until it comes into engagement with the moving part 87 of the toner container 8. This makes it possible to keep the light window A4 closed as long as possible during the mounting process to thereby protect the reading unit B from being soiled, over a longer time period.

Figure 22:
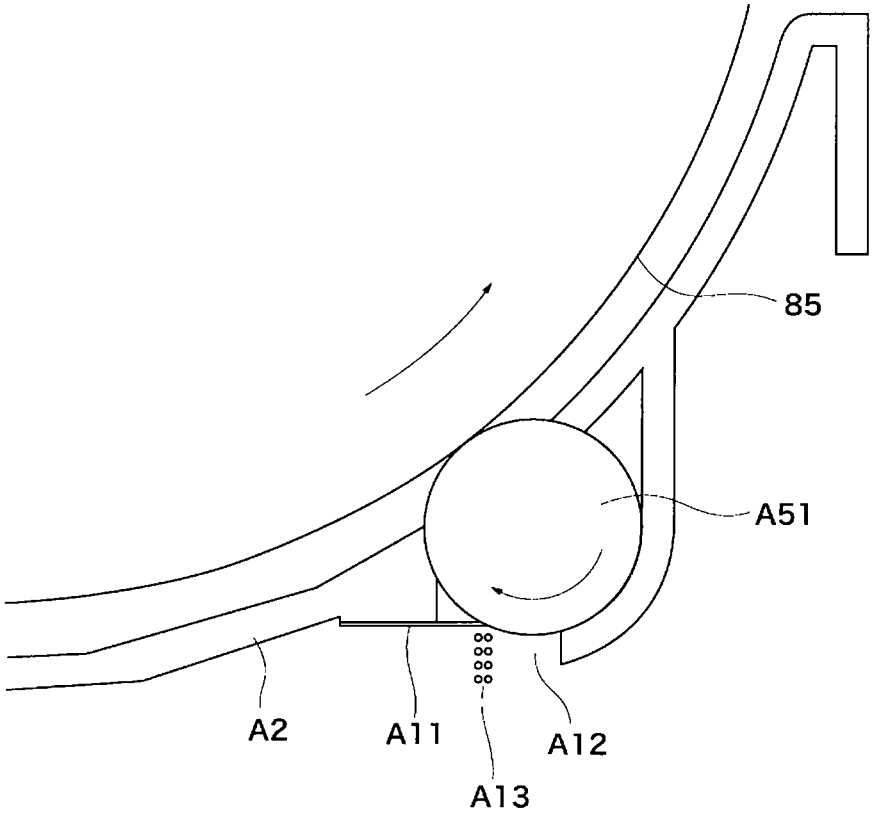
FIG. 22 is a view of essential parts of a variation of the present embodiment in which a cleaning member for cleaning the surface of the holding roller is provided on the lower holder.

FIG. 22 is a view of essential parts of a variation of the present embodiment in which a cleaning member A11 for cleaning the surface of the holding roller A51 is provided on the lower holder A2. FIG. 22 shows the relationship between the holding roller A51 and the cleaning member A11 (PET sheet or the like) in a state where the toner container 8 is mounted (the holding roller A51 is in its position in FIG. 19A). The cleaning member A11 is provided at such a location that it is in contact with the surface of the holding roller A51 in its position in FIG. 19A.

When a large amount of toner is dropped from the replenishment port 81 by an operation for mounting or removing the toner container 8, the cleaning member A11 scrapes off toner A13 deposited on the surface of the holding roller A51.

More specifically, in the state shown in FIG. 19B, the holding roller A51 only has a fixed portion of its surface soiled, whereas in the state shown in FIG. 19A, the holding roller A51 rotates, and hence the soiled portion of its surface circumferentially changes its position. When the holding roller A51 in a state where the soiled surface portion has circumferentially changed its position is shifted to the position in FIG. 19B again, if the soiled surface portion is in a position facing the light window A4, it soils the reading unit B. Therefore, it is preferred that the holding roller A51 is cleaned when the holding roller A51 is in its position shown in FIG. 19A.

In mounting or removing the toner container 8, even when the moving part (rib) 87 is formed on the outer periphery of the toner container 8 as in the above-described embodiments, the toner container 8 is movable thanks to the existence of the gap A14 (see FIG. 5) between the holding unit A and the surface of the toner container 8. Further, even when the pressure application device A6 is provided, since the pressure application device A6 urged by the pressing spring A62 can be retracted, it is to be understood that there is no problem in the operation for mounting or removing the toner container 8.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-115465, filed May 12, 2009, which is hereby incorporated by reference herein in its entirety.

What is claimed is:

1. An image forming apparatus in which a toner container is rotatably mounted, comprising:

a sensor configured to read information from an information recording part formed on an outer periphery of the toner container;

a first positioning member configured to come into contact with the outer periphery of the toner container to position the toner container; and a second positioning member that is disposed adjacent to said first positioning member in a circumferential direction of the toner container, and is configured to be pivotally movable with respect to said first positioning member such that said second positioning member is brought into contact with the outer periphery of the toner container, wherein said sensor is configured to move in accordance with movement of said second positioning member.

2. The image forming apparatus according to claim 1, wherein said second positioning member is movable in accordance with each of an operation for mounting the toner container and an operation for removing the toner container, and covers said sensor by an operation for removing the toner container.

3. An image forming apparatus in which a toner container is rotatably mounted, comprising:

a sensor configured to read information from an information recording part formed on an outer periphery of the toner container; and a positioning member configured to come into contact with the outer periphery of the toner container to position the toner container, wherein said sensor and said positioning member are disposed such that an angle difference between an angular position of said sensor and an angular position of said positioning member is within 10 degrees, with respect to a rotation center of the toner container, and wherein said positioning member is movable in accordance with an operation for mounting or removing the toner container, and covers said sensor when the toner container is removed.

4. An image forming apparatus in which a toner container is rotatably mounted, comprising:

a sensor configured to read information from an information recording part formed on an outer periphery of the toner container; and a positioning member configured to come into contact with the outer periphery of the toner container to position the toner container, wherein said sensor and said positioning member are disposed such that an angle difference between an angular position of said sensor and an angular position of said positioning member is within 10 degrees, with respect to a rotation center of the toner container, and wherein said positioning member is a rotary member, the image forming apparatus further comprising a fixing part configured to fix said positioning member so as to prevent rotation of said positioning member when said positioning member is in a state covering said sensor.

5. An image forming apparatus in which a toner container is rotatably mounted, comprising:

a sensor configured to read information from an information recording part formed on an outer periphery of the toner container; and a positioning member configured to come into contact with the outer periphery of the toner container to position the toner container, wherein said sensor and said positioning member are disposed such that an angle difference between an angular position of said sensor and an angular position of said positioning member is within 10 degrees, with respect to a rotation center of the toner container, and wherein said positioning member is a rotary member, the image forming apparatus further comprising a cleaning member configured to clean said positioning member in a state where said positioning member is not covering said sensor.

6. An image forming apparatus in which a toner container is rotatably mounted, comprising:

a sensor configured to read information from an information recording part formed on an outer periphery of the toner container;

a first positioning member configured to come into contact with the outer periphery of the toner container to position the toner container; and a second positioning member configured to come into contact with the outer periphery of the toner container to position the toner container, the second positioning member being disposed in a circumferential direction of the toner container relative to said first positioning member, wherein said sensor and said first positioning member are disposed such that an angle difference between an angular position of said sensor and an angular position of said first positioning member is within 10 degrees, with respect to a rotation center of the toner container.

* * * * *